US011566788B2

(12) United States Patent
Isbell

(10) Patent No.: US 11,566,788 B2
(45) Date of Patent: Jan. 31, 2023

(54) FIRE-STARTING TOOL AND ASSOCIATED METHOD(S)

(71) Applicant: James Isbell, Jacksonville, FL (US)

(72) Inventor: James Isbell, Jacksonville, FL (US)

( * ) Notice: Subject to any disclaimer, the term of this patent is extended or adjusted under 35 U.S.C. 154(b) by 0 days.

(21) Appl. No.: 17/657,050

(22) Filed: Mar. 29, 2022

(65) Prior Publication Data

US 2022/0221150 A1 Jul. 14, 2022

Related U.S. Application Data

(63) Continuation-in-part of application No. 29/817,313, filed on Nov. 30, 2021, which is a continuation-in-part of application No. 29/652,803, filed on Dec. 5, 2020, now Pat. No. Des. 948,942.

(60) Provisional application No. 63/167,577, filed on Mar. 29, 2021.

(51) Int. Cl.
*F23Q 1/06* (2006.01)
*F23Q 2/18* (2006.01)

(52) U.S. Cl.
CPC ..... *F23Q 1/06* (2013.01); *F23Q 2/18* (2013.01)

(58) Field of Classification Search
CPC ... F23Q 1/06; F23Q 2/18; C10L 11/00; C10L 11/04; C10L 11/06
See application file for complete search history.

(56) References Cited

U.S. PATENT DOCUMENTS

| | | | | |
|---|---|---|---|---|
| 2,032,695 | A * | 3/1936 | Gimera | F23Q 2/40 431/151 |
| 4,188,192 | A * | 2/1980 | Levenson | C10L 11/00 44/643 |
| 5,279,628 | A * | 1/1994 | Hutchens | C10L 11/00 44/507 |
| 8,186,995 | B2 * | 5/2012 | Putrello, Jr. | F23Q 1/06 431/267 |
| D679,141 | S * | 4/2013 | Slack | D7/416 |
| 9,732,959 | B2 * | 8/2017 | Holland | F23Q 1/06 |
| 10,684,011 | B2 * | 6/2020 | Seitler, Jr. | A45C 13/008 |
| D911,108 | S * | 2/2021 | Hofer | D32/46 |
| D948,942 | S * | 4/2022 | Isbell | D7/416 |
| 2019/0368733 | A1 * | 12/2019 | Millan | A45F 5/02 |
| 2022/0057168 | A1 * | 2/2022 | Lindstrom | F41G 11/003 |

* cited by examiner

*Primary Examiner* — Alfred Basichas
(74) *Attorney, Agent, or Firm* — Ashkan Najafi

(57) ABSTRACT

A fire-starting tool includes a striker, a holder, a rod supported by the holder, and an ignitable implement disposed adjacent to the rod and being selectively supported by the holder. The ignitable implement is configured to be slidably displaced along a longitudinal length of the holder. The striker is configured to be engaged with the rod in such a manner that the ignitable implement is lit on fire and selectively adjusted relative to a position of the holder.

18 Claims, 12 Drawing Sheets

FIRE-STARTING TOOL AND ASSOCIATED METHOD(S)

CROSS REFERENCE TO RELATED APPLICATIONS

This is a non-provisional patent application that claims priority to and benefit of U.S. provisional patent application No. 63/167,577 filed Mar. 29, 2021. This non-provisional patent application is also a continuation-in-part application of U.S. design patent application Ser. No. 29/817,313 filed Nov. 30, 2021, which is a continuation-in-part patent application of U.S. design patent application Ser. No. 29/652,803 filed Dec. 5, 2020, all of which are incorporated by reference herein in their entireties.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to fire-starting tools and, more particularly, to a specially configured fire-starting tool including an adjustable and ignitable implement in communication with a ferrocerium rod holder and a striker for enabling a user to succinctly manipulate a position of a flame.

Prior Art

Fire-starting tools are widely used by those involved in camping and other outdoor activities. There are presently many different types of fire igniting devices capable of lighting outdoor fires made of branches or the like, of which matches are the most common. However, matches are difficult to handle in high-wind situations, and the amount of heat generated by a match is typically insufficient to kindle fires in rainy or cold weather conditions. Moreover, matches become useless when wet.

Other devices widely used to kindle fires include various types of lighters, in which a supply of fuel such as butane, alcohol or the like is stored in a reservoir within the body of the lighter.

When living outdoors for extended time periods, the ability of build a fire without matches is very important. One way is to use a flint stone and a piece of steel. By scraping the piece of steel, such as a blade of knife, against the flint stone, sparks are produced that can ignite a dry tinder nest. Unfortunately, if a flint stone, a piece of steel, or dry tinder are rarely available, making a fire can be difficult.

Another problem with using a flint stone and piece of steel is that they are normally carried in a backpack or pocket and can be easily broken or lost.

Also known are methods of kindling fires using a particular magnesium alloy as the igniting material. This method basically includes the steps of producing some shavings of ignitable material from a stick of mischmetal-magnesium alloy and subsequently striking the stick itself with a hard object (the stick thereby also serving as a pyrophoric implement) to create a spark to ignite the shavings. For example, known fire-starting apparatuses include a body of shavable magnesium-based alloy and a separate pyrophoric implement secured to the body. Pyrophoric materials have been used to ignite a fire. Pyrophoric materials are substances that ignite instantly upon exposure to oxygen. Examples of such materials include metal hydrides, finely divided metal powders, nonmetal hydride and alkyl compounds, white phosphorus, alloy of reactive materials and organometallic compounds, including alkyl-lithiums. Devices of this type generally produce the dazzling white flame and high temperatures characteristic of the instantaneous combustion of magnesium.

Accordingly, a need remains for a fire-starting tool in order to overcome at least one of the above-noted shortcomings. The exemplary embodiment(s) satisfy such a need by a specially configured fire-starting tool including an adjustable and ignitable implement in communication with a ferrocerium rod holder and a striker that is convenient and easy to use, lightweight yet durable in design, versatile in its applications, and configured to succinctly manipulate a position of a flame.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a specially configured fire-starting tool including an adjustable and ignitable implement in communication with a ferrocerium rod holder and a striker for enabling a user to succinctly manipulate a position of a flame. These and other objects, features, and advantages of the non-limiting exemplary embodiment(s) are provided by a fire-starting tool including a striker, a holder, a rod supported by the holder, and an ignitable implement disposed adjacent to the rod and being selectively supported by the holder. Advantageously, the ignitable implement is configured to be slidably displaced along a longitudinal length of the holder. Advantageously, the striker is configured to be engaged with the rod in such a manner that the ignitable implement is lit on fire and selectively adjusted relative to a position of the holder.

In a non-limiting exemplary embodiment, each of the striker, the holder, and the rod is suitably sized and shaped to be grasped within a user hand.

In a non-limiting exemplary embodiment, the holder includes a single and unitary body including a channel having an open top side an arcuately shaped bottom side, and an axial bore extended along the longitudinal length thereof. Advantageously, the axial bore is registered parallel to the channel.

In a non-limiting exemplary embodiment, the rod is statically positioned along the channel.

In a non-limiting exemplary embodiment, the rod is removably positioned along the channel.

In a non-limiting exemplary embodiment, the ignitable implement is inserted through the axial bore and selectively displaced adjacent to the channel.

In a non-limiting exemplary embodiment, the axial bore includes an open proximal end and an open distal end oppositely situated therefrom. Advantageously, ignitable implement ingresses the open proximal end and selectively egressing the open distal end.

In a non-limiting exemplary embodiment, the ignitable implement includes an outer surface having a flammable agent (e.g., lighter fluid) coated thereon.

In a non-limiting exemplary embodiment, the rod includes a pyrophoric rod including ferrocerium.

In a non-limiting exemplary embodiment, the fire-starting tool further includes a fastener intermediately coupled to the ignitable implement and the striker.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
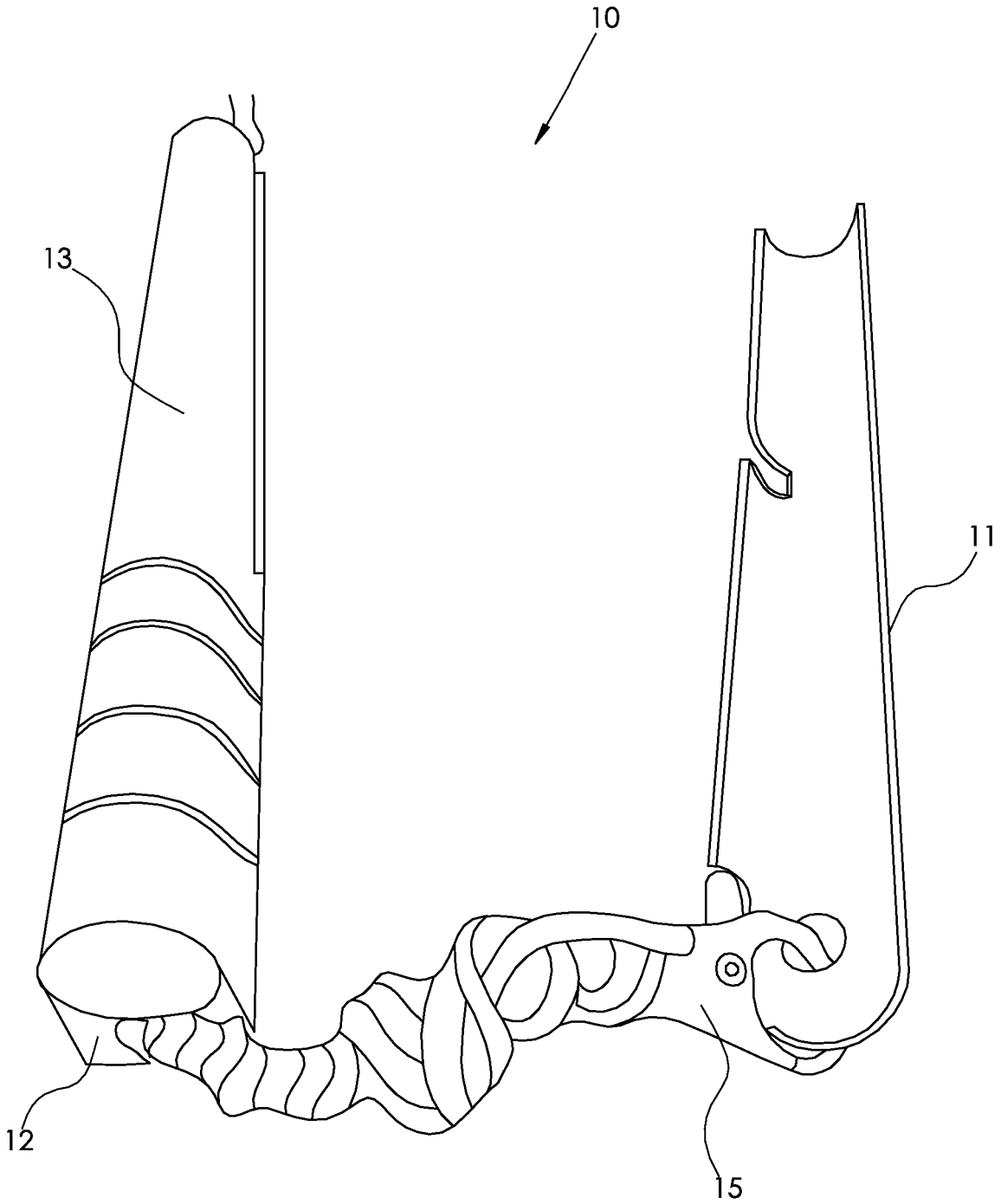
FIG. 1 is a perspective view of a fire-starting tool, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means±15% of the numerical.

If used herein, "substantially" means largely if not wholly that which is specified but so close that the difference is insignificant.

Figure 2:
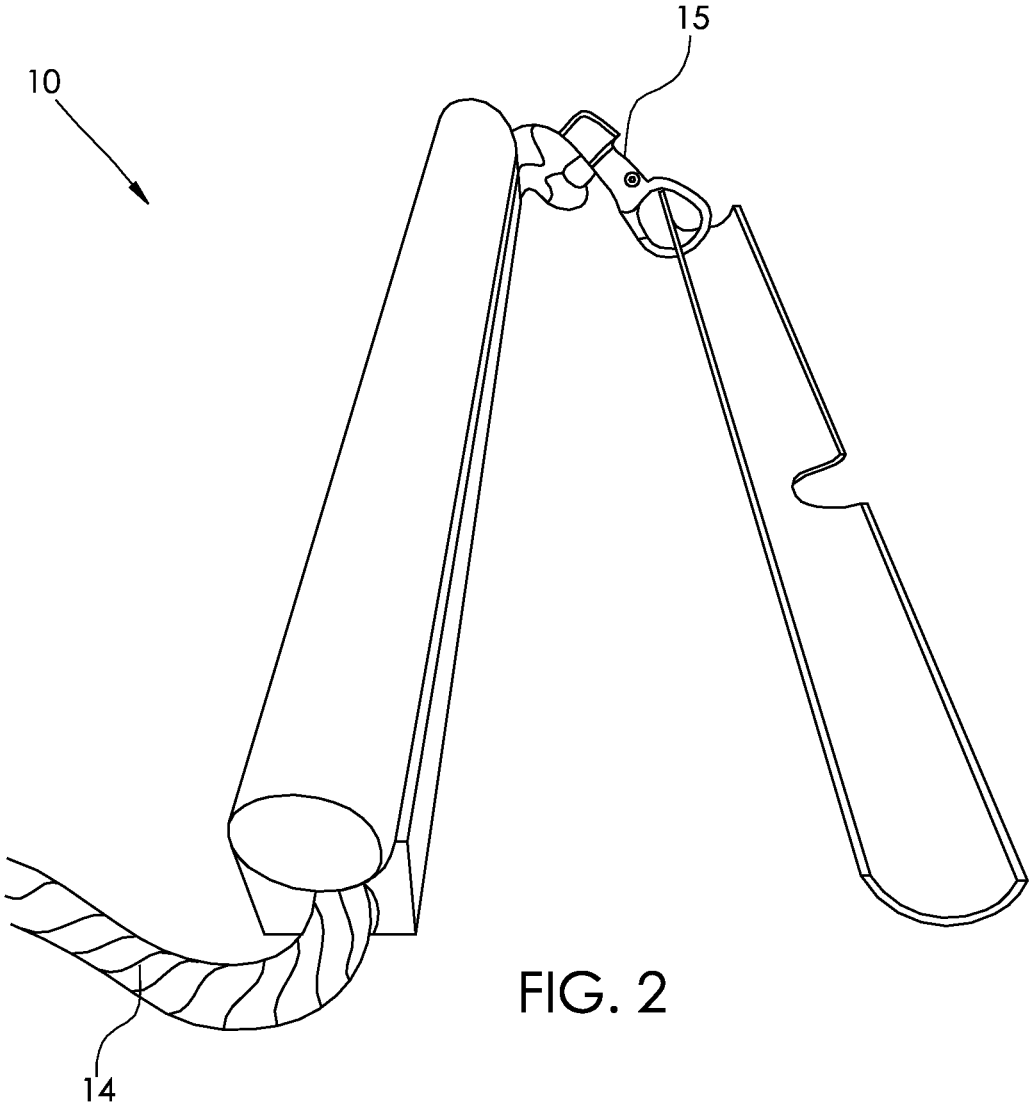
FIG. 2 is another perspective view of a fire-starting tool shown in FIG. 1.
Figure 3:
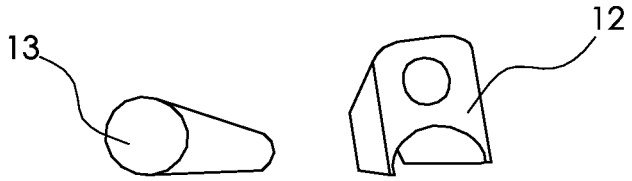
FIG. 3 is a top plan view of the ferro rod and associated holder shown in FIG. 1, wherein the ferro rod is detached from the associated holder.
Figure 4:
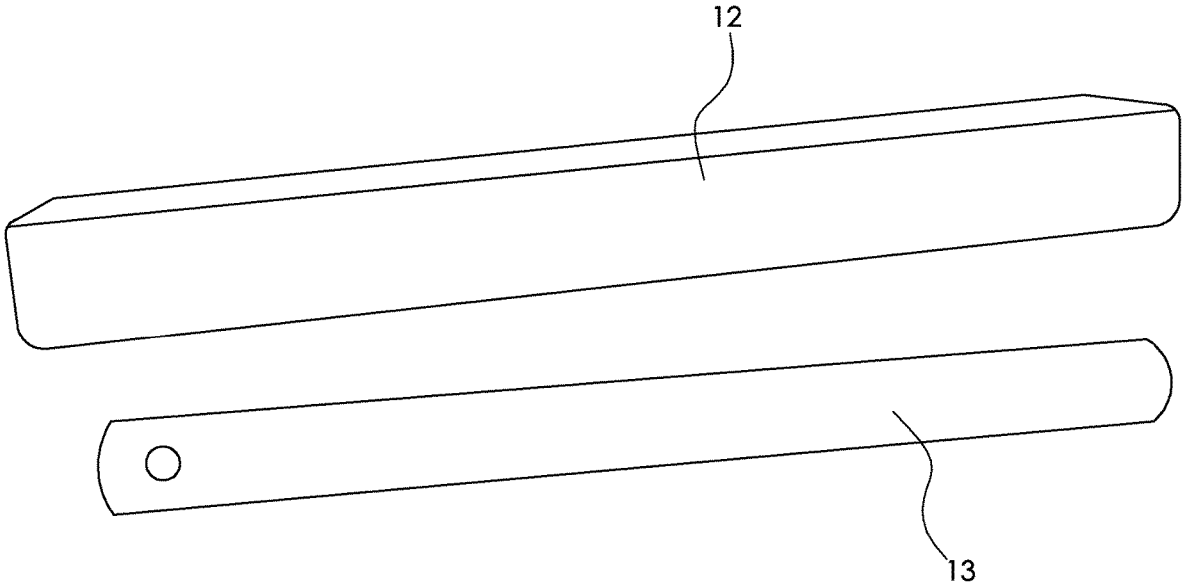
FIG. 4 is a side elevational view of the ferro rod and associated holder shown in FIG. 3.
Figure 5:
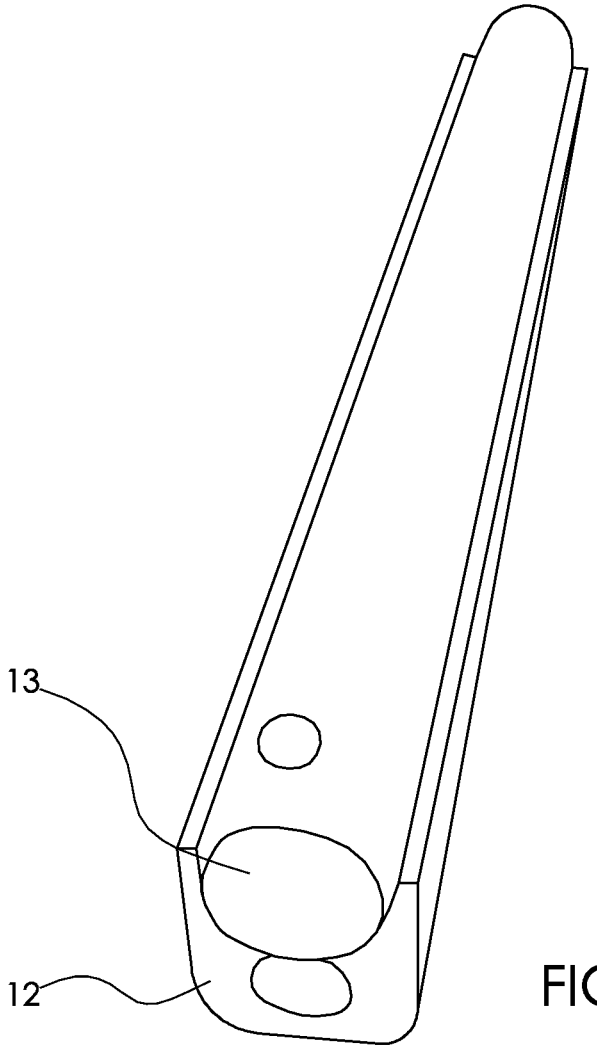
FIG. 5 is another perspective view of the ferro rod and associated holder shown in FIG. 1, wherein the ferro rod is detached from the associated holder.
Figure 6:
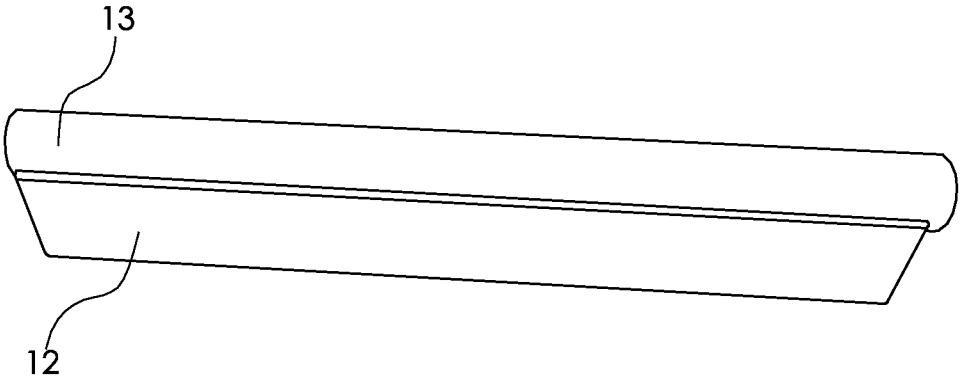
FIG. 6 is a side elevational view of the ferro rod and associated holder shown in FIG. 5.
Figure 7:
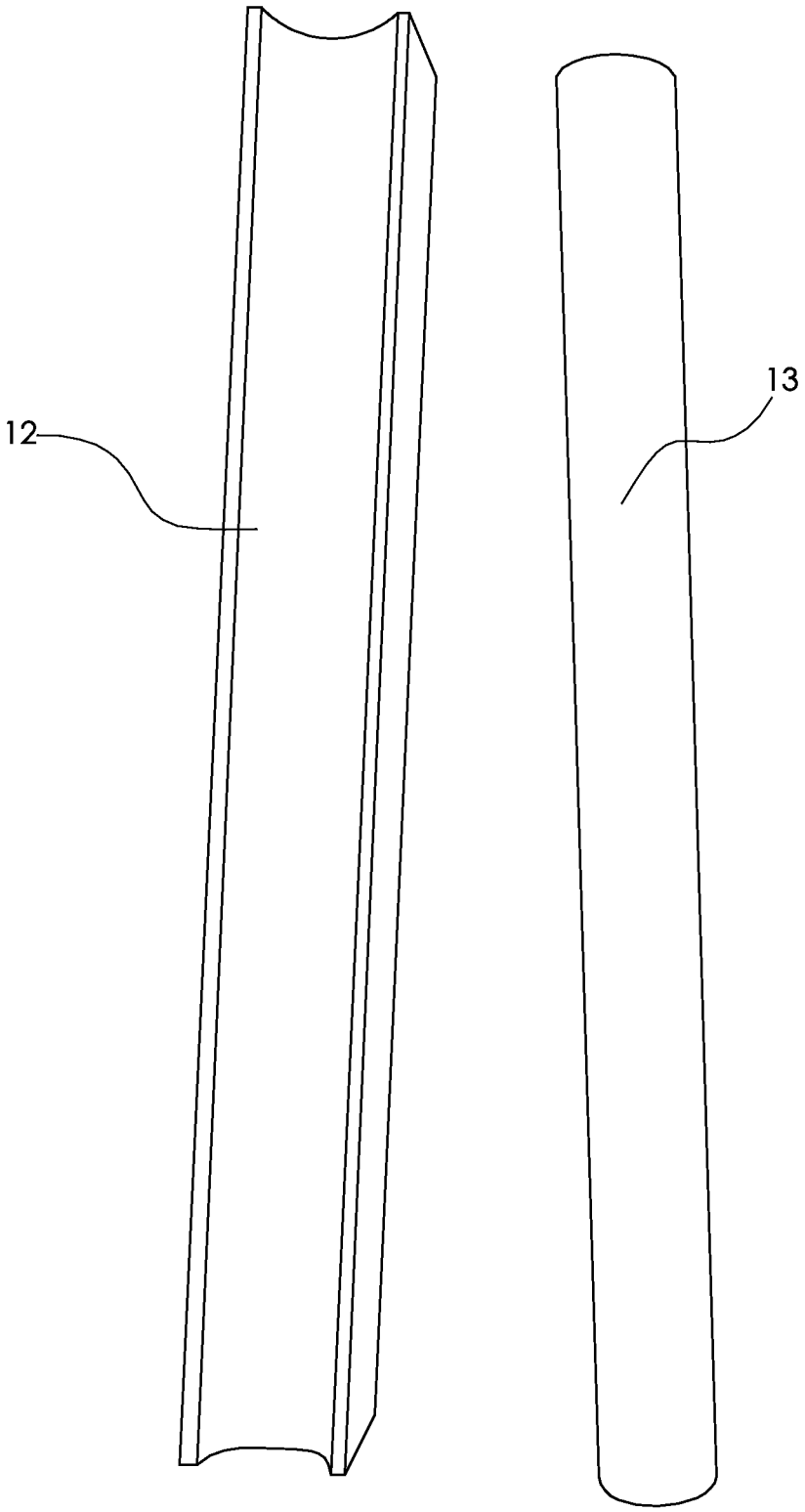
FIG. 7 is a front elevational view of the ferro rod and associated holder shown in FIG. 4.
Figure 8:
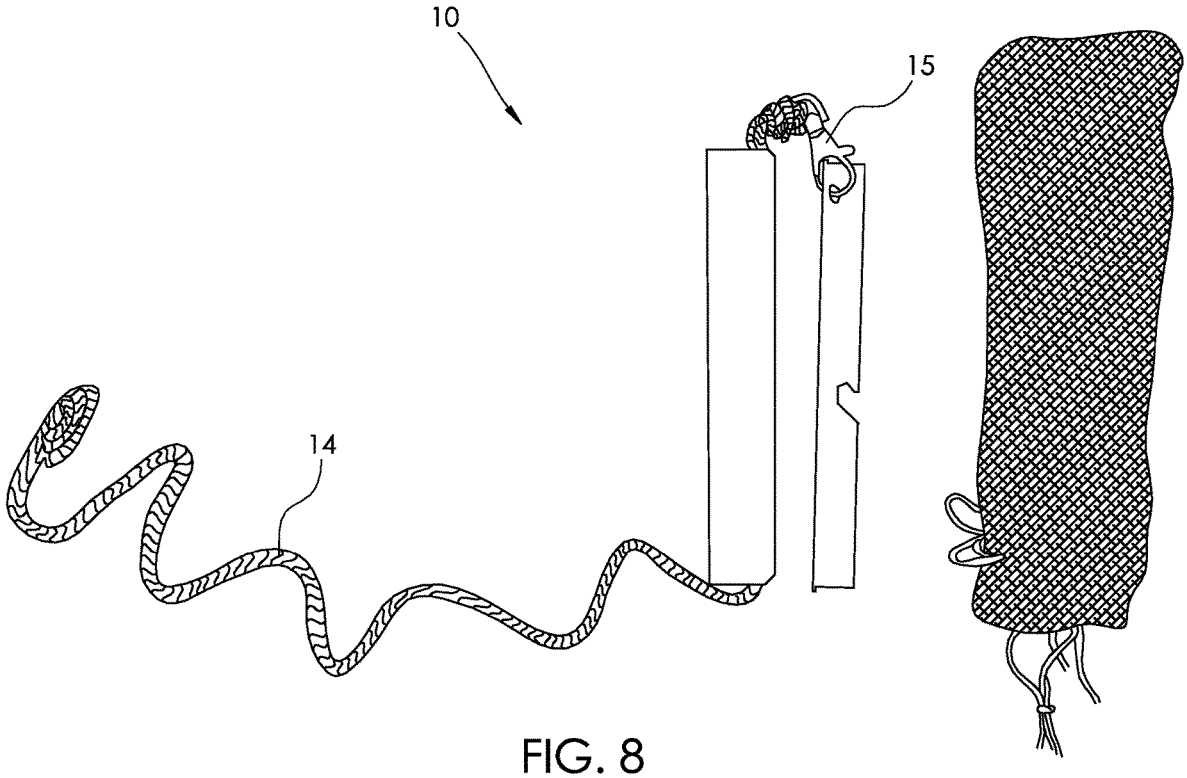
FIG. 8 is a top plan view of the fire-starting tool shown in FIG. 1, wherein a carrying pouch is also included.
Figure 9:
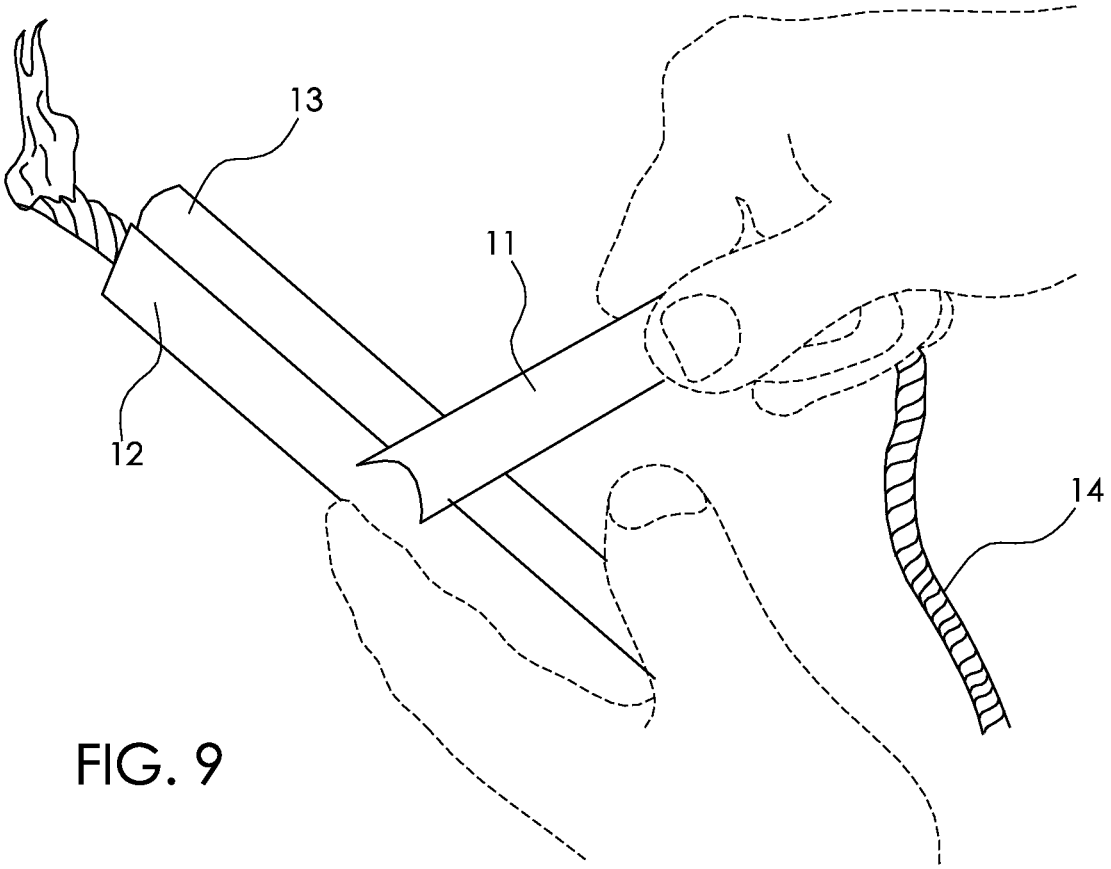
FIG. 9 is another perspective view of the fire-starting tool shown in during use, in accordance with another non-limiting exemplary embodiment of the present disclosure.
Figure 10:
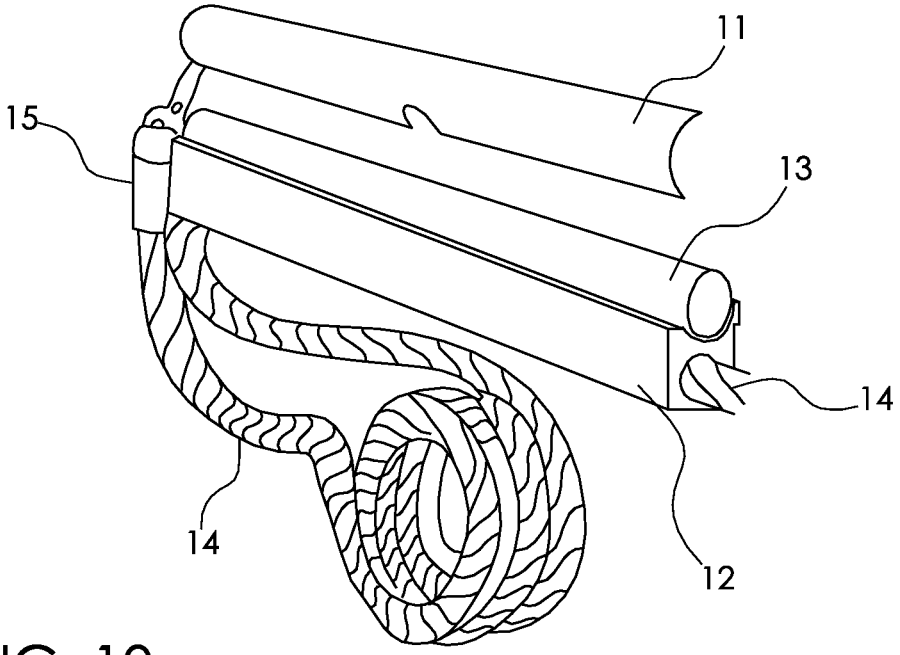
FIG. 10 is another perspective view of the fire-starting tool shown in FIG. 9.
Figure 11:
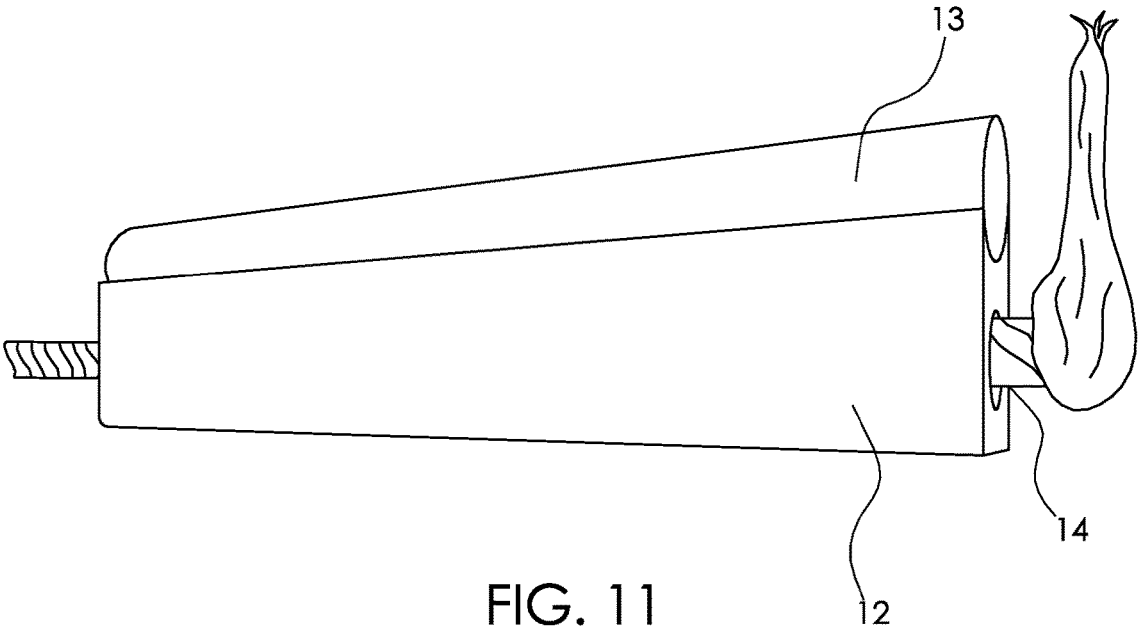
FIG. 11 is an enlarged perspective view of the ferro rod, associated holder, and the ignitable implement passed through the holder shown in FIG. 9.
Figure 12:
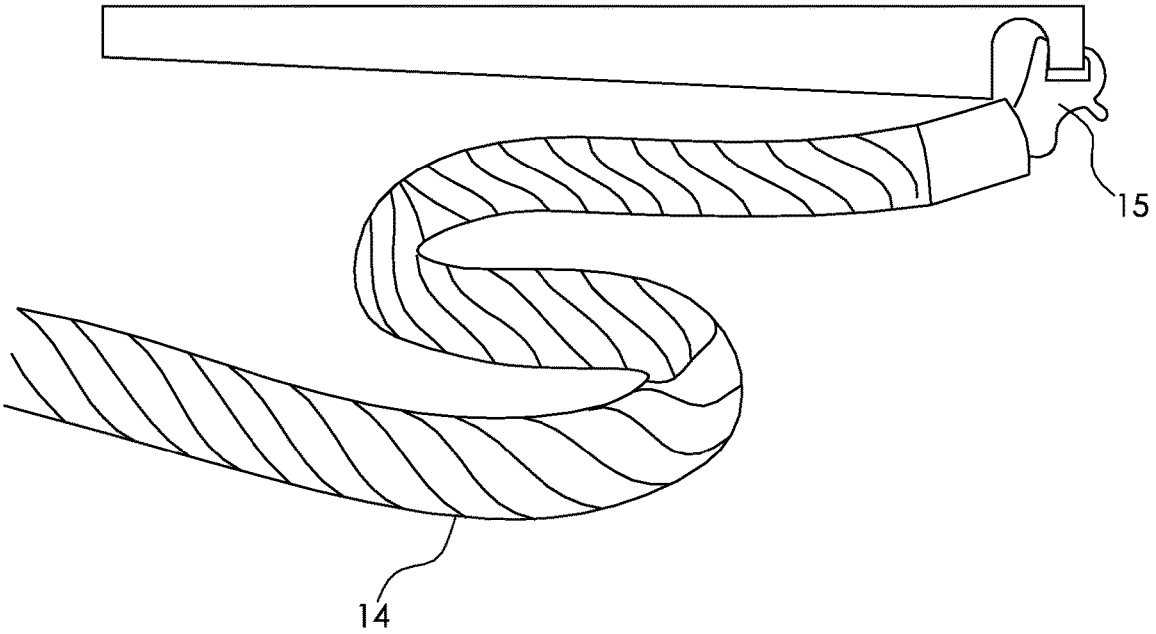
FIG. 12 is an enlarged perspective view of the ignitable implement shown in FIG. 9.
Figure 13:
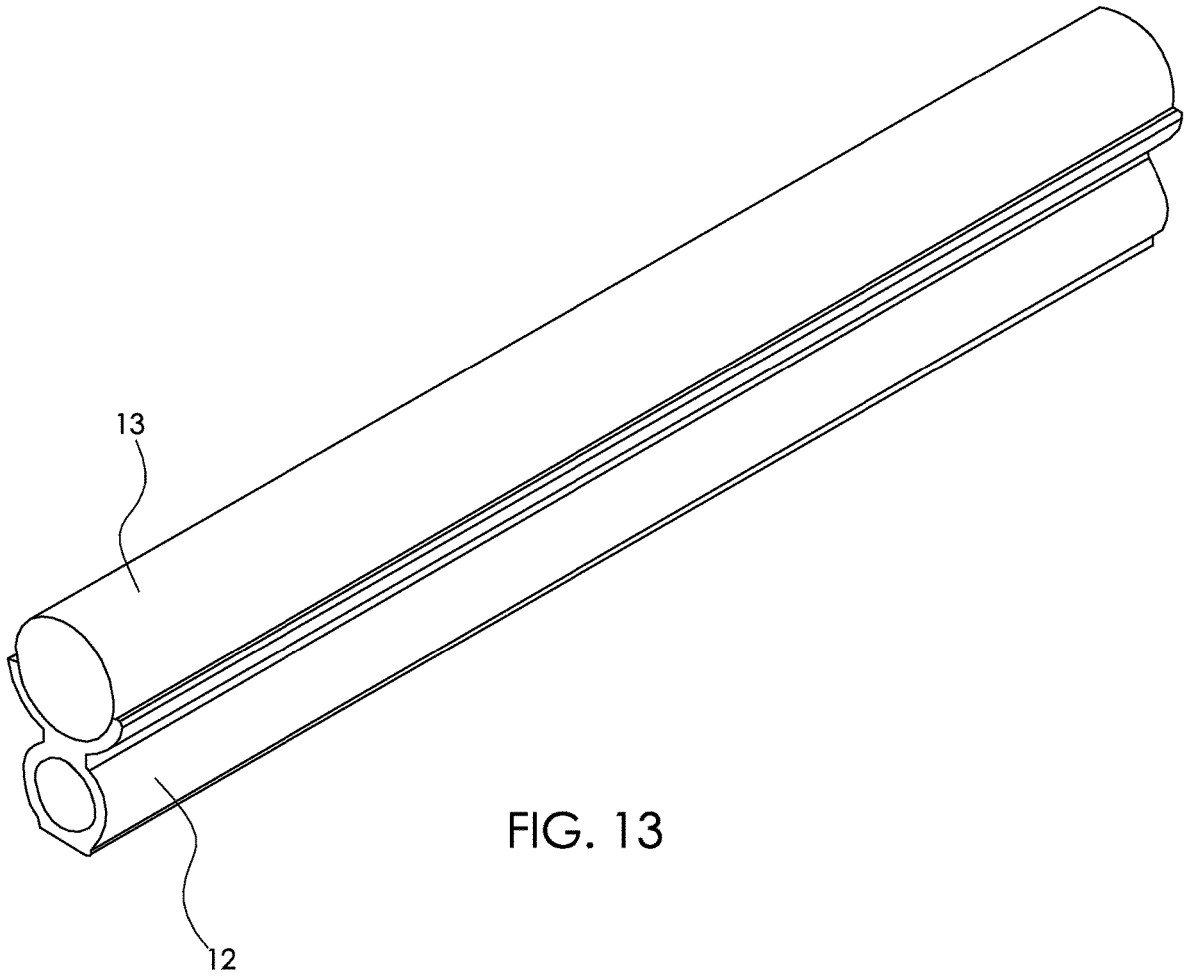
FIG. 13 is a perspective view of the ferro rod and associated holder, in accordance with another non-limiting exemplary embodiment of the present disclosure.
Figure 14:
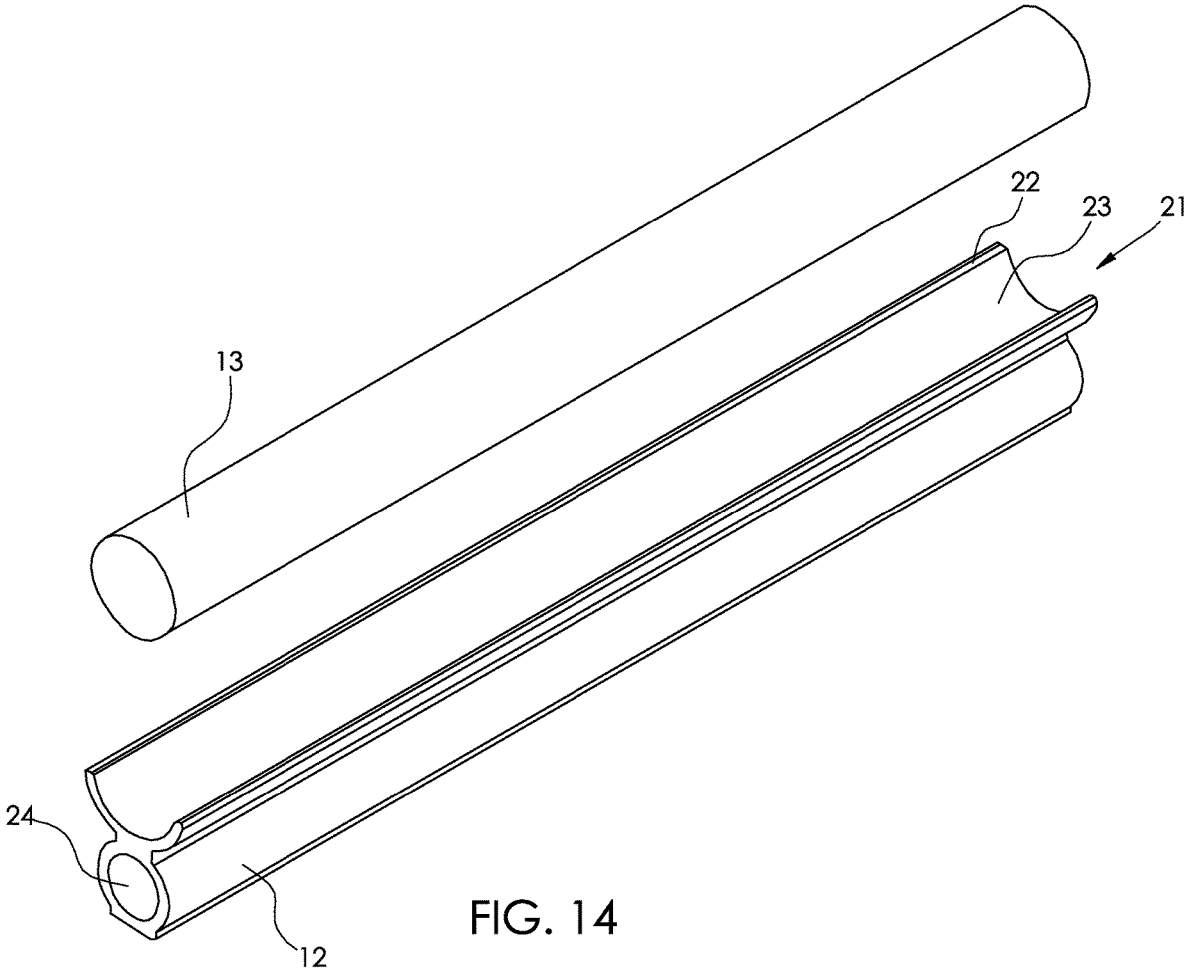
FIG. 14 is a perspective view of the ferro rod and associated holder shown in FIG. 13.
Figure 15:
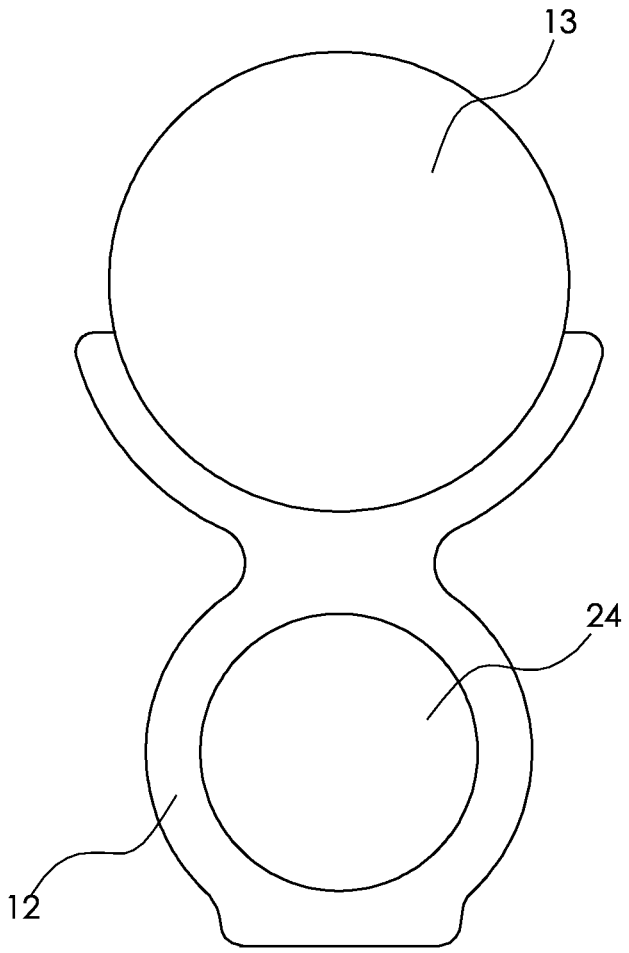
FIG. 15 is an enlarged front elevational view of the ferro rod and associated holder shown in FIG. 13.
Figure 16:
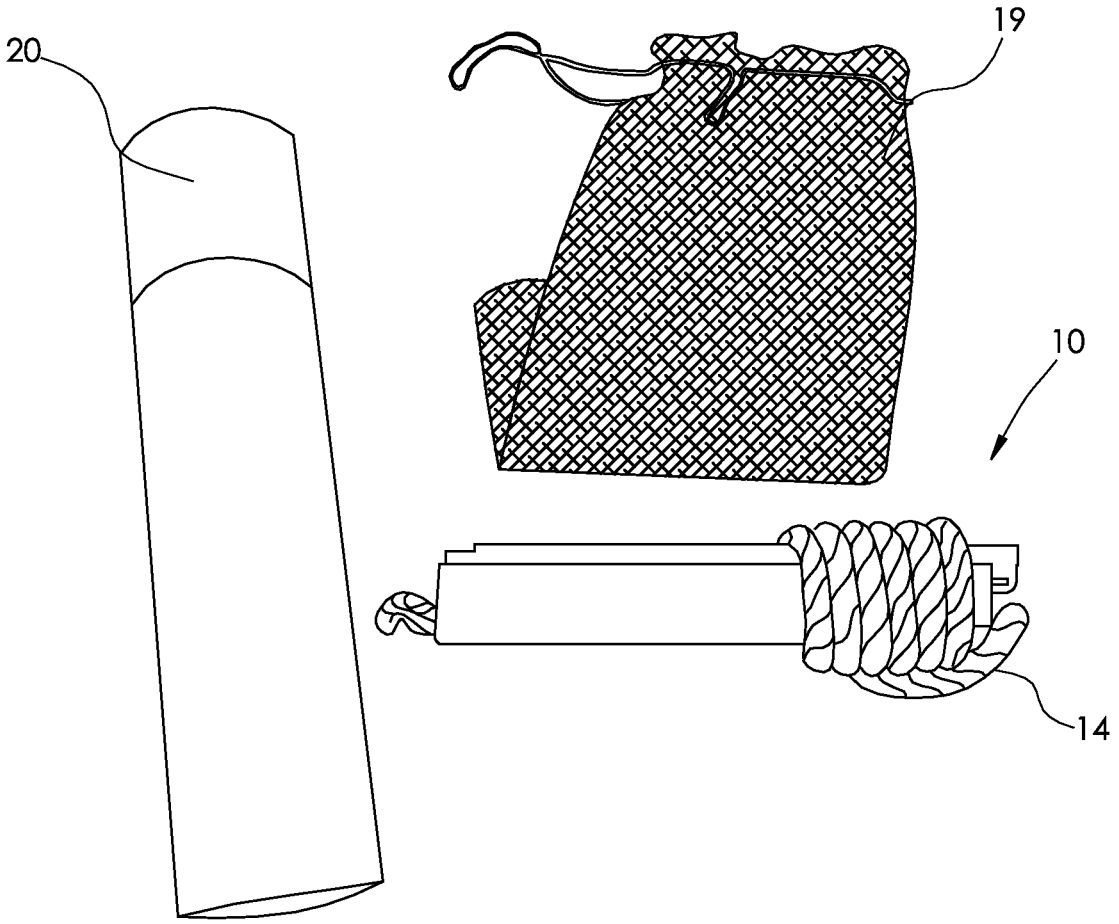
FIG. 16 is a perspective view of the fire-starting tool and associated carrying pouch, in accordance with another non-limiting exemplary embodiment of the present disclosure.

The non-limiting exemplary embodiment(s) is/are referred to generally in FIGS. 1-16 and is/are intended to provide a specially configured fire-starting tool 10 including an adjustable and ignitable implement 14 in communication with a ferrocerium rod 13 and associated holder 12 and a striker 11 for enabling a user to succinctly manipulate a position of a flame. It should be understood that the exemplary embodiment(s) may be used to ignite a variety of combustible implements and should not be limited to any particular described herein.

In a non-limiting exemplary embodiment, the fire-starting tool 10 facilitates safe and repeated fire-starting in windy or rainy weather conditions. At least a portion of the ignoble implement 14 remains protected from inclement weather until ready for use. The pyrophoric rod 13 and striker 11 are advantageously sized to permit the creation of a spark that will ignite a reusable supply of ignitable material. The ignitable implement 14 may include a flint impregnated (soaked) with a flammable agent, which can be readily ignited and that is capable of generating sufficient heat for an extended period of time to the ignitable implement 14 (flint), while remaining structurally sound as the flint burns. Advantageously, each of the striker 11, the holder 12, and the rod 13 have a substantially same longitudinal length. Such a structural configuration yields the new, useful, and unpredicted result of maintaining the ignitable implement at a stable position as well as allowing the user to selectively adjust a distance that the distal tip of the ignitable implement extends beyond the axial bore. This helps the user manipulate a position and angle of the flame as needed.

In a not-limiting exemplary embodiment, the pyrophoric rod 13 is made of ferrocerium. Ferrocerium is a synthetic pyrophoric alloy that produces hot sparks that can reach temperatures of (5,430° F.) when rapidly oxidized by the process of striking the rod 13, thereby fragmenting it and exposing those fragments to the oxygen in the air. Such a structural configuration yields the new, useful, and unpredicted result of maintaining the ignitable implement at a stable position as well as allowing the user to selectively adjust a distance that the distal tip of the ignitable implement extends beyond the axial bore. This helps the user manipulate a position and angle of the flame as needed.

In a non-limiting exemplary embodiment, the pyrophoric rod 13 may include a cerium alloy also more commonly known as mischmetal, which is a blend of rare earth materials. To increase hardness, cerium is combined with an iron alloy to produce ferrocerium, which is a brittle material. Striking the pyrophoric rod 13 with a hard object such as striker 11 creates high temperature sparks. To facilitate use of the pyrophoric rod 13 with striker 11, an end portion of the ignitable implement 14 is adjustably and slidably passed through a holder 12 attached to the pyrophoric rod 13. Such an end portion can be extended out from the holder 12 or retracted back into the holder 12 as needed during use and non-use, respectively. Such a structural configuration yields the new, useful, and unpredicted result of maintaining the ignitable implement at a stable position as well as allowing the user to selectively adjust a distance that the distal tip of the ignitable implement extends beyond the axial bore. This helps the user manipulate a position and angle of the flame as needed.

Referring to FIGS. 1-8 general, in a non-limiting exemplary embodiment(s), the fire-starting tool 10 including a striker 11, a holder 12, a rod 13 supported by the holder 12, and an ignitable implement 14 disposed adjacent to the rod 13 and being selectively supported by the holder 12. Advantageously, the ignitable implement 14 is configured to be slidably displaced along a longitudinal length of the holder 12. Advantageously, the striker 11 is configured to be engaged with the rod 13 in such a manner that the ignitable implement 14 is lit on fire and selectively adjusted relative to a position of the holder 12. Such a structural configuration yields the new, useful, and unpredicted result of maintaining the ignitable implement at a stable position as well as allowing the user to selectively adjust a distance that the distal tip of the ignitable implement extends beyond the axial bore. This helps the user manipulate a position and angle of the flame as needed.

In a non-limiting exemplary embodiment, each of the striker 11, the holder 12, and the rod 13 is suitably sized and shaped to be grasped within a user hand.

In a non-limiting exemplary embodiment, the holder 12 includes a single and unitary body including a channel 21 having an open top side 22 an arcuately shaped bottom side 23, and an axial bore 24 extended along the longitudinal length thereof. Advantageously, the axial bore 24 is registered parallel to the channel 21. Such a structural configuration yields the new, useful, and unpredicted result of maintaining the ignitable implement at a stable position as well as allowing the user to selectively adjust a distance that the distal tip of the ignitable implement extends beyond the axial bore 24. This helps the user manipulate a position and angle of the flame as needed.

In a non-limiting exemplary embodiment, the rod 13 is statically positioned along the channel 21.

In a non-limiting exemplary embodiment, the rod 13 is removably positioned along the channel 21. Such a structural configuration yields the new, useful, and unpredicted result of maintaining the ignitable implement at a stable position as well as allowing the user to selectively adjust a distance that the distal tip of the ignitable implement extends beyond the axial bore 24. This helps the user manipulate a position and angle of the flame as needed.

In a non-limiting exemplary embodiment, the ignitable implement 14 is inserted through the axial bore 24 and selectively displaced adjacent to the channel 21. Such a structural configuration yields the new, useful, and unpredicted result of maintaining the ignitable implement at a stable position as well as allowing the user to selectively adjust a distance that the distal tip of the ignitable implement extends beyond the axial bore 24. This helps the user manipulate a position and angle of the flame as needed.

In a non-limiting exemplary embodiment, the axial bore 24 includes an open proximal end and an open distal end oppositely situated therefrom. Advantageously, ignitable implement 14 ingresses the open proximal end and selectively egressing the open distal end. Such a structural configuration yields the new, useful, and unpredicted result of maintaining the ignitable implement at a stable position as well as allowing the user to selectively adjust a distance that the distal tip of the ignitable implement extends beyond the axial bore 24. This helps the user manipulate a position and angle of the flame as needed.

In a non-limiting exemplary embodiment, the ignitable implement 14 includes an outer surface having a flammable agent (e.g., lighter fluid) coated thereon. Such a structural configuration yields the new, useful, and unpredicted result of maintaining the ignitable implement at a stable position as well as allowing the user to selectively adjust a distance that the distal tip of the ignitable implement extends beyond the axial bore 24. This helps the user manipulate a position and angle of the flame as needed.

In a non-limiting exemplary embodiment, the rod 13 includes a pyrophoric rod 13 including ferrocerium. Such a structural configuration yields the new, useful, and unpredicted result of maintaining the ignitable implement at a stable position as well as allowing the user to selectively adjust a distance that the distal tip of the ignitable implement extends beyond the axial bore 24. This helps the user manipulate a position and angle of the flame as needed.

In a non-limiting exemplary embodiment, the fire-starting tool 10 further includes a fastener 15 intermediately coupled to the ignitable implement 14 and the striker 11. Such a structural configuration yields the new, useful, and unpredicted result of maintaining the ignitable implement at a stable position as well as allowing the user to selectively adjust a distance that the distal tip of the ignitable implement extends beyond the axial bore 24. This helps the user manipulate a position and angle of the flame as needed.

In a non-limiting exemplary embodiment, a carrying pouch 19 or case 20 may be provided for transporting the fire-starting tool 10 during non-operating conditions.

In a non-limiting exemplary embodiment, the axial bore 24 is monolithically and integrally attached to the channel 21, axial bore 24 extends along an entire longitudinal length of the single and unitary body, and the axial bore 24 extends along an entire longitudinal length of the channel 21. Such a structural configuration yields the new, useful, and unpredicted result of maintaining the ignitable implement at a stable position as well as allowing the user to selectively adjust a distance that the distal tip of the ignitable implement extends beyond the axial bore 24. This helps the user manipulate a position and angle of the flame as needed.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus, the following claims are hereby incorporated into the Detailed Description, with each claim standing on its own as a separately claimed subject matter.

What is claimed as new and what is desired to secure by Letters Patent of the United States is:

1. A fire-starting tool comprising:

a striker;

a holder;

a rod supported by said holder; and an ignitable implement disposed adjacent to said rod and being selectively supported by said holder;

wherein said ignitable implement is configured to be slidably displaced along a longitudinal length of said holder;

wherein said ignitable implement is passed through said holder and supported by said holder;

wherein said striker is configured to be engaged with said rod in such a manner that said ignitable implement is lit on fire and selectively adjusted relative to a position of said holder;

wherein said holder comprises: a single and unitary body including a channel having an open top side an arcuately shaped bottom side, and an axial bore extended along the longitudinal length thereof, wherein said axial bore is registered parallel to said channel, wherein said axial bore is monolithically and integrally attached to said channel;

wherein said axial bore extends along an entire longitudinal length of said single and unitary body;

wherein said axial bore extends along an entire longitudinal length of said channel.

2. The fire-starting tool of claim 1, wherein each of said striker, said holder, and said rod is suitably sized and shaped to be grasped within a user hand.

3. The fire-starting tool of claim 1, wherein said rod is statically positioned along said channel.

4. The fire-starting tool of claim 1, wherein said rod is removably positioned along said channel.

5. The fire-starting tool of claim 1, wherein said ignitable implement is inserted through said axial bore and selectively displaced adjacent to said channel.

6. The fire-starting tool of claim 1, wherein said axial bore comprises: an open proximal end and an open distal end oppositely situated therefrom, said ignitable implement ingressing said open proximal end and selectively egressing said open distal end.

7. The fire-starting tool of claim 1, wherein said ignitable implement comprises: an outer surface having a flammable agent coated thereon.

8. The fire-starting tool of claim 1, wherein said rod comprises: a pyrophoric rod including ferrocerium.

9. The fire-starting tool of claim 1, further comprising: a fastener intermediately coupled to said ignitable implement and said striker.

10. A fire-starting tool comprising:

a striker;

a holder;

a rod supported by said holder; and an ignitable implement disposed adjacent to said rod and being selectively supported by said holder;

wherein said ignitable implement is configured to be slidably displaced along a longitudinal length of said holder;

wherein said ignitable implement is passed through said holder and supported by said holder;

wherein said striker is configured to be engaged with said rod in such a manner that said ignitable implement is lit on fire and selectively adjusted relative to a position of said holder;

wherein each of said striker, said holder, and said rod have a substantially same longitudinal length;

wherein said holder comprises: a single and unitary body including a channel having an open top side an arcuately shaped bottom side, and an axial bore extended along the longitudinal length thereof, wherein said axial bore is registered parallel to said channel, wherein said axial bore is monolithically and integrally attached to said channel;

wherein said axial bore extends along an entire longitudinal length of said single and unitary body;

wherein said axial bore extends along an entire longitudinal length of said channel.

11. The fire-starting tool of claim 10, wherein said ignitable implement is inserted through said axial bore and selectively displaced adjacent to said channel.

12. The fire-starting tool of claim 10, wherein each of said striker, said holder, and said rod is suitably sized and shaped to be grasped within a user hand.

13. The fire-starting tool of claim 10, wherein said rod is statically positioned along said channel.

14. The fire-starting tool of claim 10, wherein said rod is removably positioned along said channel.

15. The fire-starting tool of claim 10, wherein said axial bore comprises: an open proximal end and an open distal end oppositely situated therefrom, said ignitable implement ingressing said open proximal end and selectively egressing said open distal end.

16. The fire-starting tool of claim 10, wherein said ignitable implement comprises: an outer surface having a flammable agent coated thereon.

17. The fire-starting tool of claim 10, wherein said rod comprises: a pyrophoric rod including ferrocerium.

18. The fire-starting tool of claim 10, further comprising: a fastener intermediately coupled to said ignitable implement and said striker.

* * * * *